United States Patent [19]

Lund

[11] Patent Number: 4,850,439

[45] Date of Patent: Jul. 25, 1989

[54] METHOD AND A DRILLING RIG FOR DRILLING A BORE WELL

[75] Inventor: Thomas A. Lund, Birkerod, Denmark

[73] Assignee: Dansk Industri Syndikat A/S, Herlev, Denmark

[21] Appl. No.: 79,769

[22] PCT Filed: Oct. 29, 1986

[86] PCT No.: PCT/DK86/00120

§ 371 Date: Jul. 7, 1987

§ 102(e) Date: Jul. 7, 1987

[87] PCT Pub. No.: WO87/02915

PCT Pub. Date: May 21, 1987

[30] Foreign Application Priority Data

Nov. 8, 1985 [DK] Denmark ..... 5172/85

[51] Int. Cl.[4] ..... E21B 19/20

[52] U.S. Cl. ..... 175/52; 175/57; 175/85; 414/22.63

[58] Field of Search ..... 175/52, 57, 85, 170, 175/161, 162; 166/77.5, 78; 414/22

[56] References Cited

U.S. PATENT DOCUMENTS

| | | | |
|---|---|---|---|
| 2,730,246 | 1/1956 | Stone | 414/22 |
| 3,533,516 | 10/1970 | Guier | 414/22 |
| 4,348,920 | 9/1982 | Boyadjieff | 175/85 |
| 4,421,179 | 12/1983 | Boyadjieff | 175/85 |
| 4,423,994 | 1/1984 | Schefers et al. | 175/85 |
| 4,610,315 | 9/1986 | Koga et al. | 414/22 |
| 4,709,766 | 12/1987 | Boyadjieff | 414/22 |

FOREIGN PATENT DOCUMENTS

| | | |
|---|---|---|
| 2064321 | 7/1971 | France . |
| 2092611 | 1/1972 | France . |

*Primary Examiner*—Stephen J. Novosad

*Assistant Examiner*—Terry Lee Melius

*Attorney, Agent, or Firm*—Merchant, Gould, Smith, Edell, Welter & Schmidt

[57] ABSTRACT

Drilling equipment, especially for offshore use, comprises a drill floor or platform (11) with a derrick (10) extending upwards therefrom. A first hoist (12) connected to the upper part of the derrick is used for passing a length of a tubular body (19), such as a drill string or a well casing, through a drilling opening (18) defined in and extending through the drill floor. The tubular length is connected to or disconnected from the drill string or well casing during the drilling operation, and such tubular lengths are strored in a storage area (31, 32) of the drill floor. The tubular lengths may be transported from the storage area to the first hoist (12) and vice versa by means of first transporting means (22). The drill floor or platform (11) also defines a preparation opening (21) extending therethrough at a location spaced from the drilling opening and from the storage area, and a second hoist or a preparation hoist (20) is connected to the upper part of the derrick above the preparation opening. Two or more tubular sections may then be assembled to tubular lengths at the preparation opening by means of the preparation hoist while the drilling operation is going on at the drilling opening, and the prepared lengths may be transported to and stored in the storage area ready for use at the drilling opening. Similarly, tubular lengths may be disassembled into tubular sections at the preparation opening before they are to be transported from the drilling site. The possibility of assembling and disassembling tubular lengths form tubular sections at the preparation opening while the drilling operation is going on at the drilling opening substantially reduces the necessary idle time in drilling operations.

26 Claims, 6 Drawing Sheets

METHOD AND A DRILLING RIG FOR DRILLING A BORE WELL

Figure 1:
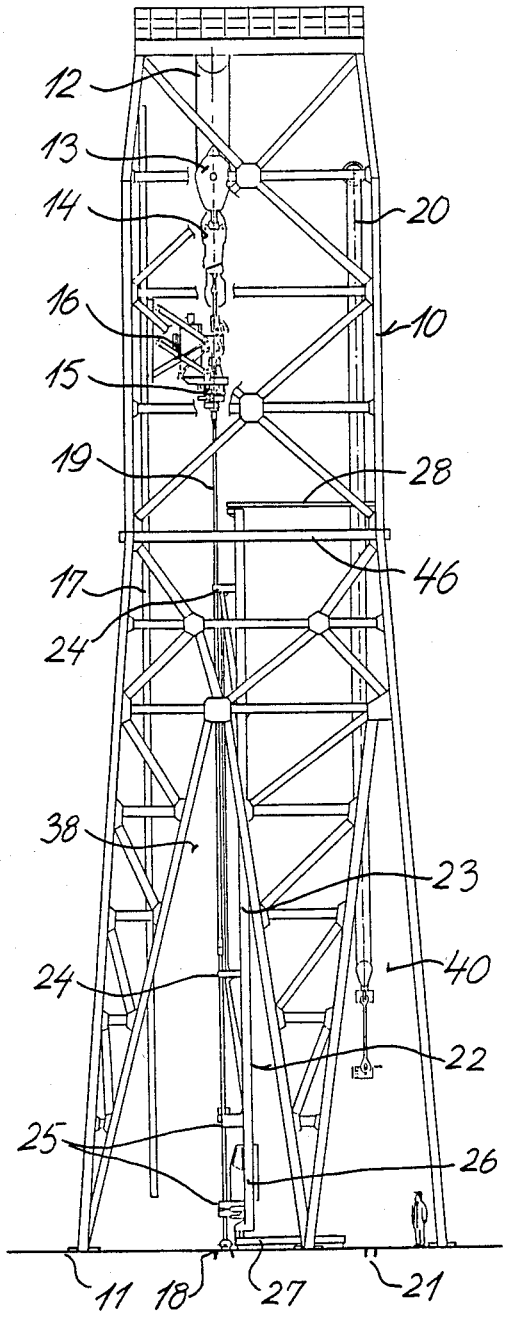

The present invention relates to a method of drilling a bore well by means of drilling equipment which comprises a drill floor or platform with a derrick extending upwards therefrom, a first hoist connected to the upper part of the derrick for passing a tubular body which includes a plurality of releasably interconnected tubular body sections through a drilling opening defined in the drill floor which also defines a storage area for storing tubular body sections, and transporting means for transporting tubular body sections from the storage area to the first hoist and vice versa.

In rotary drilling two different types of equipment are commonly used for rotating the drill string, viz. the so-called top drive and the rotary table drive. Before starting actual drilling operations, a conductor pipe is rammed into the ground at the drilling side, and thereafter a so-called bottomhole assembly comprising a drill bit, drill collars and possible other tubular elements or sections, is mounted while suspended above the drilling opening in the drill floor by means of the said first hoist. The bottomhole assembly may now be lowered into the conductor pipe, and drilling operations are started by rotating the bottomhole assembly by means of the top drive or the rotary table cooperating with a kelly attached to the bottomhole assembly. When the drill bit has penetrated such a distance into the underground that only a small part of the drill string extends upwards from the upper surface of the drill floor, the drilling operation must be stopped, whereafter the drill string is fastened to the drill floor by means of wedge-shaped elements—so-called slips—which are positioned in the space between the drill string and the main bushing defining the drilling opening in the drill floor. The top drive or the kelly may then be disconnected from the drill string, and a tubular drill string section is now moved from a storage site or rack positioned outside the drill floor and supporting a stock of drill string sections in a horizontal position. Each drill string section is brought in from the rack to the drill floor by means of an auxiliary hoist or tackle through a so-called V-door formed in the derrick, and the new drill string section is placed vertically in a holding socket—the so-called mousehole—formed in and extending downwards from the drill floor and positioned adjacent to the drilling opening. When the top drive or the kelly has been disconnected from the drill string extending through the drilling hole, the top drive or kelly may be swung to such a position that it may be connected to the upper end of the drill string section positioned in the mousehole. Now, the new drill string section is lifted from the mousehole to a position in which its lower end may be connected to the upper end of the drill string, and after releasing the slips from the drilling opening, the drilling operation may be continued. Normally, the length of the drill string sections is 30 feet or about 10 m. This means that each time the drill bit has penetrated further 10 m into the underground, the drilling operation has to be stopped, and a further drill string section has to be added as described above.

The bore well which has been drilled, is normally provided with a tubular lining, the so-called well casing. As the drilling proceeds, the well casing also has to be prolonged by adding casing sections, which normally have a length of about 15 m each, and which are brought in from a storage site positioned outsite the drill floor.

From time to time it is necessary to remove the total drill string from the bore well, for example in order to replace the drill bit or the total bottomhole assembly, by a so-called tripping-out operation. Then the drill string is normally withdrawn from the bore well stepwise, and in each step a drill string length—a so-called stand—each normally comprising two (double) or three (triple) interconnected drill string sections is disconnected. These stands, which may be doubles having a length of about 20 m or triples having a length of about 30 m, are then stored in a storage area on the drill floor where they are maintained in a vertical position by means of a so-called fingerboard. When the total drill string has been tripped out, a new bottomhole assembly must be assembled while using the said first hoist or drilling hoist, before a tripping-in operation, by which the stands are successively removed from the fingerboard and connected to the upper end of the bottomhole assembly which is stepwise lowered into the bore well till the drill bit reaches the bottom of the well so that the rotary drilling operation may be continued.

It is understood that the necessary idle time, which means the time periods in which no actual rotary drilling operation takes place, is rather substantial. In view of the fact that the investment made in a drilling rig is very high (as an example the daily rent of an offshore rig may be in the order of U.S.$ 50,000) even a relatively small reduction of the necessary idle time is of great economical importance.

In connection with top drive drilling rigs it has been proposed to assemble two drill string sections or singles each having a length of about 10 m into a 20 m stand or double by placing the singles in the mousehole and connecting the singles by using air tuggers and spinning wrenches while the drilling operation proceeds. When the length of the drill string has to be increased, the string is pulled one section length up from the bore well, slips are set, and the upper drill string section, which is connected to the top drive, is disconnected from the remaining drill string. Then the hoist is elevated to such a position that the drill string section connected to the top drive may be tilted to a position in which its lower end may be connected to the upper end of the stand held in the mousehole, whereafter the drill hoist is moved further upwards to a position in which the lower end of the stand may be connected to the upper end of the drill string. When the slips have been released, and the hoist has been lowered one string section length, the rotary drilling may be continued. This latter known procedure permits a certain reduction in idle drilling time. However, the present invention provides a drilling method permitting a further reduction of idle time.

The present invention provides a method of drilling a bore well by means of drilling equipment which comprises a drill floor or platform with a derrick extending upwards therefrom, a first hoist connected to the upper part of the derrick for passing a tubular body which includes a plurality of releasably interconnected tubular body sections through a drilling opening defined in the drill floor which also defines a storage area for storing tubular body sections, first transporting means for transporting tubular body sections between the storage area and said first hoist, a second hoist connected to the upper part of the derrick above a preparation opening defined by opening defining means and extending through the drill floor at a location spaced from the drilling opening and from the storage area, and second transporting means for transporting tubular body sections between the storage area and said second hoist, said method comprising transporting tubular lengths, each of which includes at least two releasably interconnected tubular body sections, from the storage area to the drilling opening in a substantially vertical position by means of said first transporting means, releasably connecting said tubular lengths to the upper end of the tubular body and successively lowering the tubular body through the drilling opening by means of said first hoist, transporting tubular body sections to the preparation opening, forming a tubular length by releasably interconnecting said body sections while one of them extends through the preparation opening and another is suspended by means of said second hoist, withdrawing the prepared length from the preparation opening by means of said second hoist, and transporting the prepared length to a storage area in a substantially vertical position by means of said second transporting means.

The tubular body sections used in the method according to the invention may comprise drill tube singles, well casing singles, drill collars, stabilizers, centralizers, scratchers, drill bits, and other drill string or drill casing components as well as production tubing sections. By using the method according to the invention, such tubular body sections may be assembled into tubular lengths, such as drill string and well casing stands (usually doubles or triples), bottomhole assemblies or bottomhole assembly parts, logging assemblies, etc. at the preparation opening, while rotary drilling operation is carried on at the drilling opening, and the tubular lengths prepared at the preparation opening may be transported by means of said second transporting means in a substantially vertical position to the storage area within the confines of the derrick where they may be stored ready for use. When such tubular body lengths each including two or more interconnected tubular body sections are needed for the drilling operation, they may be transported from the storage area to the said first hoist or drilling hoist positioned above the drilling opening by means of said first transporting means. Consequently, the drilling hoist need not be used for assembling the tubular body sections into tubular body lengths, whereby idle time may be reduced and substantial savings may be obtained.

The tubular body sections (such as singles) may be supplied to the said second hoist or preparation hoist from a storage site positioned outside the drill floor, or from the storage area on the drill floor by means of the said second transporting means. When the tubular length includes three tubular body sections (a triple), this tubular length may be formed by arranging a first tubular body section in the preparation opening so that a substantial part thereof below the drill floor or platform, connecting a second tubular body section to the upper end of the first body section, and thereafter connecting a third tubular body section to the interconnected first and second body sections. When the first body section has been arranged in the preparation opening, slips may be set so as to retain the first body section in position in relation to the drill floor while the second body section is connected to the upper end of the first body section extending above the drill floor. The assembly procedure at the preparation opening may, however, be performed in different ways. According to a first embodiment of the method according to the invention the assembly procedure at the preparation opening is similar to that conventionally used at the drilling opening. Thus, the interconnected first and second body sections may be lowered so as to place the first body section and a substantial part of the second body section below the drill floor or platform, whereafter the third body section may be connected to the upper end of the second body section extending above said floor or platform, and the tubular length or triple prepared may then be withdrawn from the preparation opening by means of the second hoist.

In some cases the free space available below the preparation opening in the drill floor is not sufficient to allow the procedure just described. Therefore, according to an alternative embodiment, the method according to the invention may further comprise moving the interconnected first and second body sections upwards and out of the preparation opening, subsequently arranging the third tubular body section in the preparation opening so that a substantial part thereof extends below the drill or platform, whereafter the interconnected first and second body sections may be connected to the upper end of said third body section extending above said floor or platform. This procedure requires less free space below the preparation opening than the length of one single. When the latter procedure is used, the drilling equipment preferably comprises a third hoist, and the opening defining means defining the preparation opening may then be moved in relation to the derrick from a first to a second position after removal of the interconnected first and second body sections from the preparation opening by means of said second hoist and prior to arranging said third body section therein by means of the third hoist, and from said second position back to said first position after arranging said third body section in the preparation opening and prior to connecting the interconnected first and second body sections to the upper end of the third body section. The opening defining means which may, for example, be in the form of a second main bushing, may then be displaced between its first and second positions in which it is substantially "co-axial" with the second and third hoists, respectively. Alternatively, the opening defining means or the second main bushing may be tilted from its first position with a substantially vertically extending axis to a second position in which the axis of the main bushing defines an acute angle with the axis in said first position.

The method according to the invention may further comprise disconnecting tubular lengths from the upper end of the tubular body at the drilling opening, while successively withdrawing the tubular body upwards through the drilling opening, and transporting the disconnected tubular length from the drilling opening to the storage area in a substantially vertical position by means of said first transporting means. Such a tripping-out operation is in itself conventional. However, in case the stands or tubular lengths having been tripped out are not to be reused at the actual drilling site, or the tubular body sections included are to be used in another combination, the method according to the invention may further comprise transporting tubular lengths from the storage area to the second hoist in a substantially vertical position by means of said second transporting means, lowering each tubular length through the preparation opening by means of said second hoist, retaining the tubular length in the preparation opening, successively releasing the interconnection between adjacent tubular body sections above the upper surface of the drill floor and transporting the released body sections from the preparation opening.

Thus, the preparation opening and the preparation hoist may be used not only for assembling, but also for disassembling tubular lengths, and the resulting tubular body sections or singles may then be transported to the storage area on the drill floor or to an alternative storage site outside the drill floor. The disassembling may be carried out in alternative procedures corresponding to the alternative assembling procedures described above.

It is desirable to continue the rotary drilling during the longest possible drilling periods. Therefore, it is desirable to prepare tubular lengths or stands, which are as long as possible. However, the length of the stands should necessarily allow each stand to be connected to or disconnected from the upper end of the drill string or well casing in a vertical position. Therefore, the axial dimension of each of the tubular lengths should preferably correspond substantially to the inner free height of the derrick.

The present invention also provides a drilling rig comprising a drill floor or platform, a derrick extending upwards from the drill floor, a first hoist connected to the upper part of the derrick for passing a tubular body through a drilling opening defined in the drill floor which also defines a storage area for storing tubular body lengths, each including at least two releasably interconnected tubular body sections, first transporting means for transporting tubular body lengths between the storage area and said first hoist, a second hoist connected to the upper part of the derrick above a preparation opening defined by opening defining means and extending through the drill floor at a location spaced from the drilling opening and from the storage area, second transporting means for transporting tubular body lengths from said second hoist to the storage area, and means for interconnecting and disconnecting tubular body sections at the drilling and preparation openings, whereby tubular body sections may be assembled at the preparation opening into tubular body lengths, which are to be connected to the tubular body at the drilling opening.

In case the free space available below the preparation opening in the drill floor is less than the length of two tubular body sections (a double), the opening defining means defining the preparation opening is preferably movable between a first position in which the preparation opening is located substantially vertically below the second hoist, and a second position in which the axis of the preparation opening is offset (displaced and/or tilted) from the vertical suspension line of said second hoist, and the rig may then further comprise a third hoist positioned so that a tubular body section suspended thereby may be moved into and out of the preparation opening in said second position thereof. The drilling rig then allows for an assembling and disassembling procedure as described above in which less than one body section extends below the drill floor.

The spacing of the drilling and preparation openings is preferably chosen so that the assembling and disassembling operations taking place at the preparation opening cannot disturb or interfere with the drilling, tripping-out, and tripping-in operations taking place at the drilling opening. However, the inner free height of the derrick above the preparation opening and along a path between the preparation and drilling openings should be sufficient to allow transport of tubular body lengths or stands in a vertical position between the said openings and the storage area.

The said first and second transporting means may comprise two separately movable transporting mechanisms for transporting tubular body lengths between the storage area and the drilling opening, and between the preparation opening and the storage area, respectively. However, such separate transporting mechanisms are normally not needed and in use at the same time. Therefore, in the preferred embodiment, the first and second transporting means comprise a single gripping mechanism movable in either direction along a track passing the drilling opening, the storage area, and the preparation opening, which means that one and the same transporting mechanism may be used for transporting tubular body lengths between the storage area and the drilling and preparation openings.

The common transporting or gripping mechanism may comprise vertically aligned gripping devices arranged to grip a tubular length at axially spaced positions. The frame structure may also support at least one spinning and torquing device for connecting and disconnecting tubular body sections.

The storage is advantageously positioned between the drilling opening and the preparation opening, which means that the storage area is positioned between a pair of parallel lines extending through the drilling opening and the preparation opening, respectively, and both being at right angles to a line interconnecting said openings.

It should be understood that the drilling rig according to the invention may be a land rig as well as an offshore rig.

Figure 2:
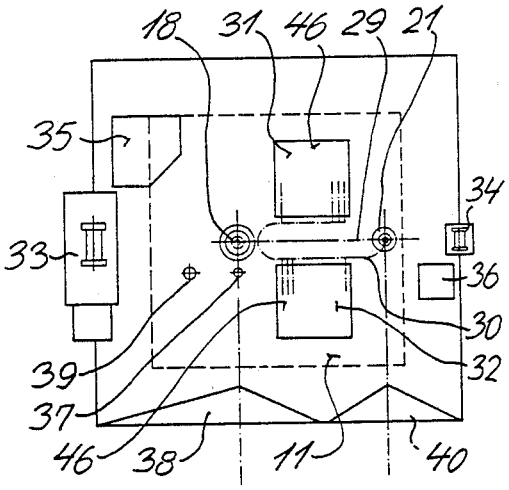

The invention will now be further described with reference to the drawings, wherein FIG. 1 is a side view of the derrick of a first embodiment of the drilling rig according to the invention, FIG. 2 is a diagrammatic top plan view showing the drill floor of the drilling rig, FIGS. 3–8 are diagrammatic side views corresponding to that shown in FIG. 1 and illustrating various steps of a first embodiment of the drilling method according to the invention, and FIGS. 9–16 are diagrammatic views in an enlarged scale of a second embodiment of the drilling rig according to the invention illustrating various steps of a second embodiment of the method according to the invention.

The drilling rig shown in FIGS. 1–8 of the drawings comprises a derrick 10 extending upwards from a drill floor or platform area 11. A drilling hoist 12 comprising a travelling block 13 and a swivel and hook assembly 14 is mounted at the upper part of the derrick 10. A top drive unit 15, which is mounted on a carriage 16 so as to be displaceable along a vertically extending track 17, is suspended by the hoist in a manner known per se.

The drilling hoist 12 and the top drive unit 15 suspended thereby are substantially aligned with a drilling opening 18 defined in the drill floor, and the top drive unit 15 may be brought into rotary driving engagement with the upper end of a drill string 19 extending through the drilling opening 18.

A preparation or assembling hoist 20 is also mounted at the upper end of the derrick 10 immediately above an assembling or preparation opening 21, which is defined in the drill floor 11. While the drilling hoist 12 should be able to carry very heavy loads, such as a complete drill string, the preparation hoist 20 should normally only be able to carry a drill string or well casing stand or a bottomhole assembly part, having a length in the order of 20 m, as will be described in more detail below.

A tube handling and transporting mechanism 22 comprises a vertically extending frame 23 and vertically aligned gripping devices 24 mounted thereon. A spinning and torquing device 25 for connecting or disconnecting threaded end portions of tubular drill string sections is also mounted on the frame 23 in alignment with the gripping devices 24. The frame 23 comprises a vertical shaft 26, which is mounted in lower and upper track members 27 and 28, so that the shaft may be moved along the track members while the frame 23 is swingable about the longitudinal axis of the shaft. The parallel, vertically spaced track members 27 and 28 define a path 29, which extends between the drilling and preparation openings 18 and 21, and along which the shaft 26 may be moved. As the frame 23 may swing around the axis of the shaft 26, each of the gripping devices 24 and the spinning and torquing device 25 may be moved along a path 30 which is indicated by a dot-and-dash line in FIG. 2. It should be understood, however, that any other suitable transporting mechanism may be used.

The drill floor 11 further comprises storage areas 31 and 32 arranged within the confines of the derrick on either side of and closely adjacent to the path 30 for storing drill string or well casing stands or bottomhole assembly parts in a vertical position, for example by means of conventional fingerboards 46. The drill floor further carries drawworks 33 associated with the drilling hoist 12 and drawworks 34 associated with the preparation hoist 20. A drillers' cabin 35 and a cabin 36 for the operator of the preparation hoist are also placed on the drill floor. In order to allow the drilling rig to be operated in a conventional manner, a so-called mousehole 37 may be defined in the drill floor closely to the drilling opening 18 so that this opening 18 and the mousehole 37 are aligned with a V-door 38 formed in the derrick. A so-called rathole 39 may also be defined in the drill floor for receiving a kelly in case it is desired to use a conventional rotary table drive in connection with the drilling rig. A second V-door 40 through which drill string and well casing components may be supplied directly to the preparation hoist 20 or the preparation opening 21, is formed in the derrick 10 in side-by-side relationship with the conventional V-door 38.

Figure 3:
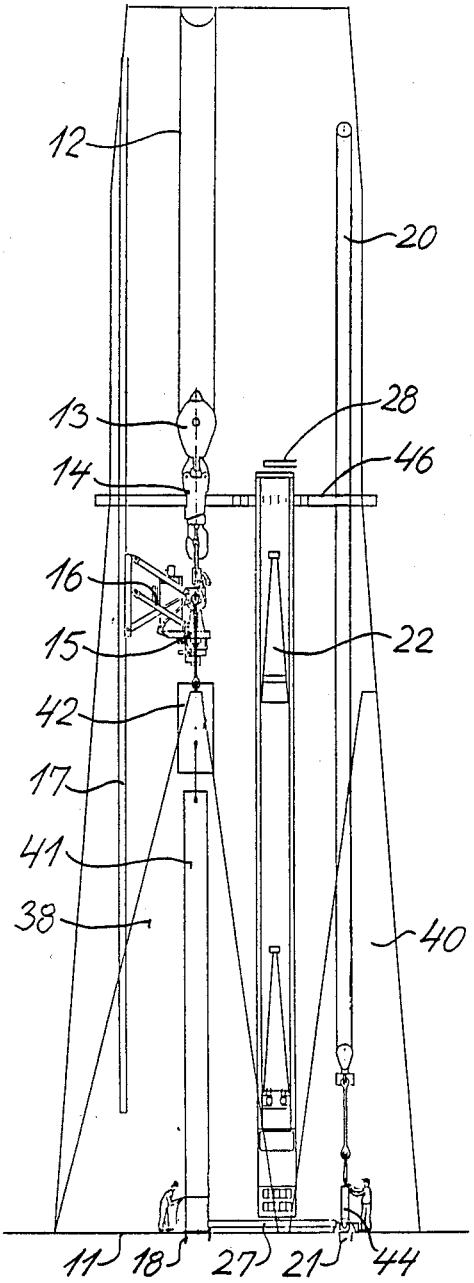
Figure 4:
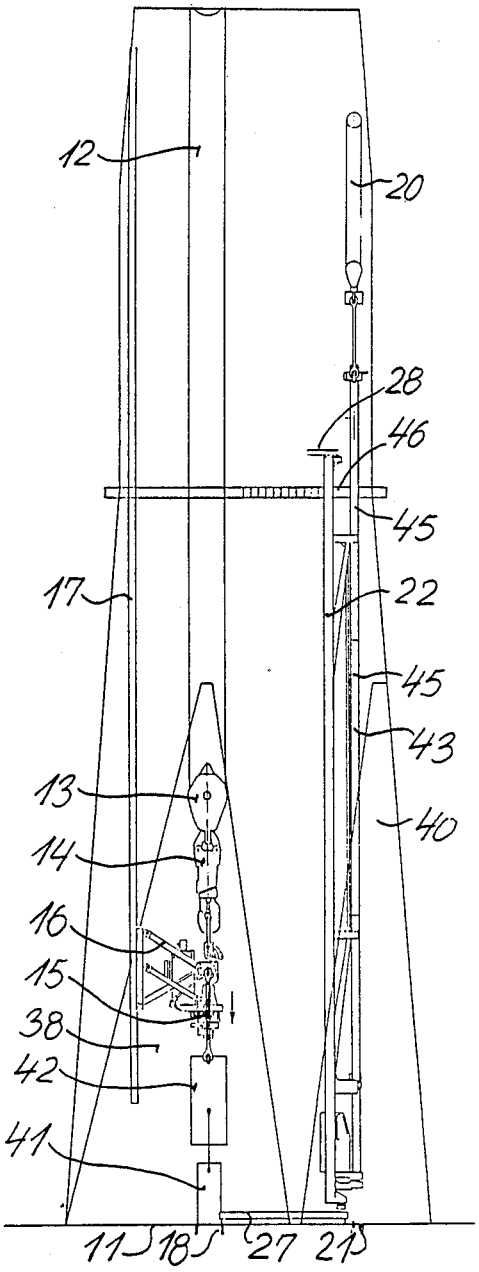

A first method of operation of the drilling rig described will now be explained in relation to FIGS. 3—8. FIGS. 3 and 4 illustrate how a conductor pipe 41 may be rammed down into the underground through the drilling opening in the drill floor 11 by means of a hammer 42 suspended in the drilling hoist 12. At the same time a bottomhole assembly part 43 comprising a drill bit 44 may be assembled in a manner described below.

In general, according to a first embodiment of the method of the invention, a triple stand 47 may be assembled in the following manner:

A first single tubular body section, such as a drill tube section 48 (FIG. 5), is brought in from outside the derrick 10 through the V-door 40 and is lowered into the preparation opening 21 by the hoist 20. Slips are set, the hoist released and a second single tubular body section or tubular is brought in through the V-door 40. The hoist 20 suspends this second single tubular above and adjacent to the first one in the preparation opening, while the two are being assembled by the spinning and torquing device 25 of the transporting mechanism 22. Slips are released and the tubular assembly is lowered by the hoist 20 into the preparation 21 to a position where the upper end of the assembly is in normal working height above the drill floor 11. Slips are set, the hoist 20 is released, and a third single tubular is brought in. The hoist suspends this third single tubular above and adjacent to the assembly in the preparation opening 21 while the single tubular is being connected to the assembly by means of the spinning and torquing device 25, FIG. 6. Slips are released and the completed triple stand (47) is lifted out of the preparation opening 21, whereafter the completed stand is gripped by the gripping devices of the transporting mechanism 22 which may move the stand to one of the storage areas 31 or 32 where the stand is left. It should be understood that stands of well casing sections and other tubular sections such as drill collar sections may be assembled as described above, and that such stands may be disconnected into singles also by a reversed procedure at the preparation opening 21.

Bottomhole assemblies 43 can be put together in a similar way as that described above, but the number of parts in a 90' (app. 30 m) assembly may be different from three. The process of making bottomhole assemblies will typically start with the drill bit 44, which is brought in and placed in a so-called bit breaker (not shown) on top of the preparation opening 21 by means of the hoist 20. The hoist 20 is then released, and a tubular, so-called BHA part 45 (FIG. 4), is brought in and suspended from the hoist, so that the lower end is contacting the drill bit. The two parts are connected by the spinning and torquing device 25 and then lifted out of the bit breaker. The bit breaker is removed and the interconnected two parts are lowered into the preparation opening 21 and set in slips. From this point on, the stand is completed in the same way as other stands of drill collar sections, drill tube sections, etc. The stands prepared may be transported to one of the storage areas 31 or 32 for later use.

When the ramming down of the conductor pipe 41 has been completed, the prepared bottomhole assembly part 43 is transported from the storage area to the drilling hoist 12 in which the bottomhole assembly is suspended and thereafter lowered into the conductor pipe. The bottomhole assembly part having its upper part extending above the drill floor 11 is now set by slips, and a stored drill collar length or stand is transported to the drilling hoist 12 which is released from the bottomhole assembly part 43 and connected to the drill collar length, which is lifted to a position in which the lower end of the drill collar length engages with the upper end of the bottomhole assembly part. The drill collar length is now connected to the bottomhole assembly part by means of the spinning and torquing device 25 of the handling and transporting mechanism 22 whereby a completed bottomhole assembly has been formed. The slips are now released, and the bottomhole assembly is lowered into the conductor pipe 41 till only the upper end of the bottomhole assembly extends above the drill floor 11. Slips are set again, and the drilling hoist 12 is released from the bottomhole assembly and connected to the prepared drill string stand 47 which has been moved to the hoist 12 from the storage area by means of the transporting mechanism 22. The drill string stand is now lifted to a position in which its lower end engages with the upper end of the bottomhole assembly, and the interengaging end portions are connected by means of the spinning and torquing device 25. The slips may now be released and the drill string so prepared may be lowered till the drill bit reaches the bottom of the well formed in the conductor tube 41. Then, the upper end of the drill string may be placed in driving engagement with the top drive unit 15 whereafter the actual drilling operation may start.

While the actual drilling operation is taking place, further drill string stands 47 (FIG. 6) may be prepared from single tubulars or drill tube sections 48 supplied through the V-door 40 as previously described. These prepared drill string stand 47 may be transported to the storage areas 31 and 32.

Figure 5:
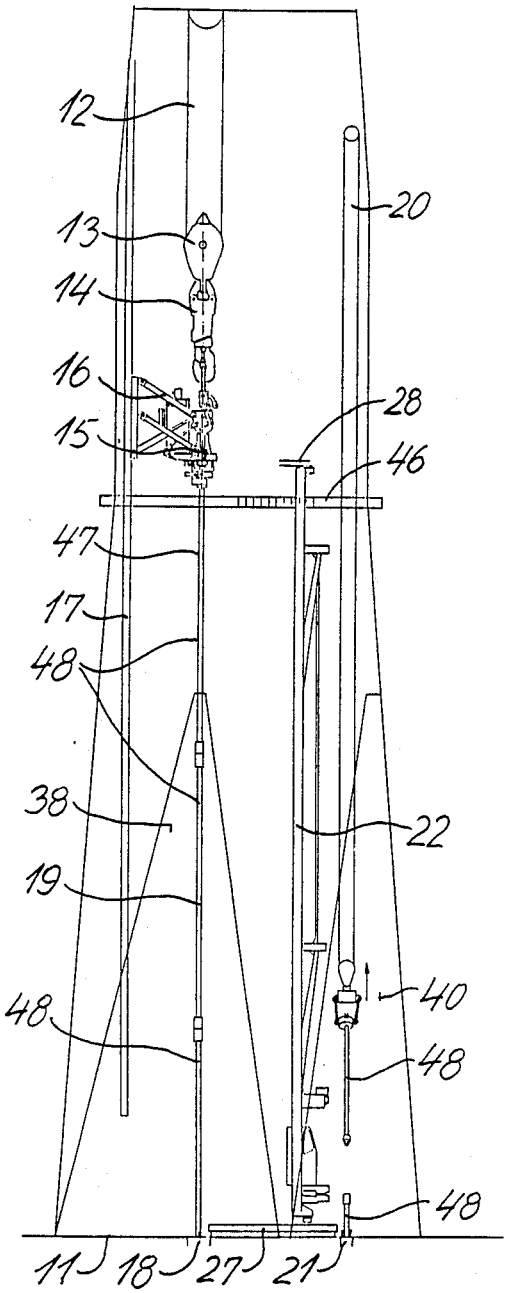
Figure 6:
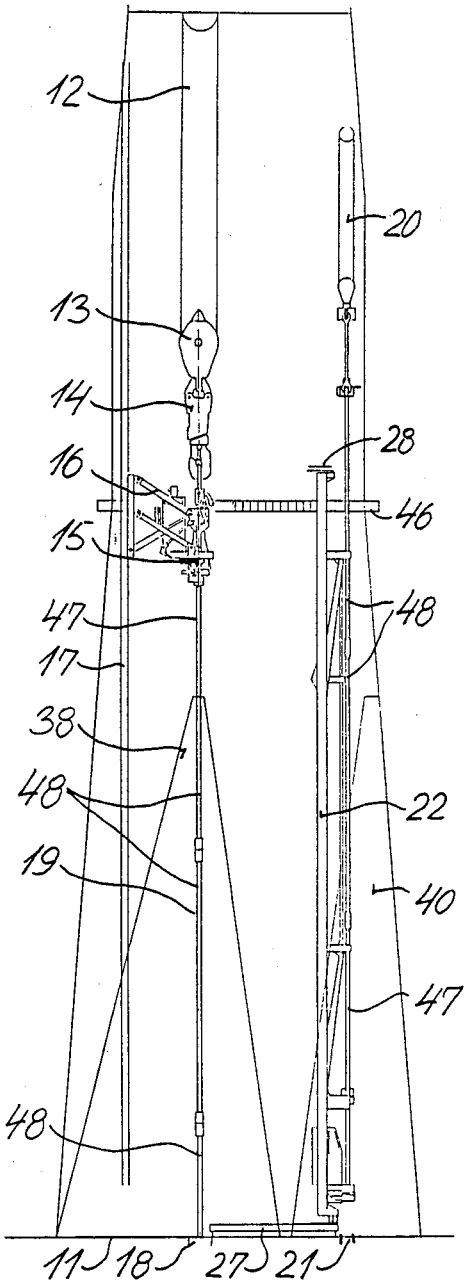

FIG. 5 illustrates the situation where the drilling operation has just been continued after addition of a drill string stand to the upper end of the drill string, which means that the top drive unit 15 is in its upper position. At the same time, a further drill string stand is being prepared at the preparation opening 21 in which a tube section 48 has been set by slips while a further tube section has just been brought in through the V-door 40 and connected to the hoist 20. In FIG. 6 for the drilling operation has proceeded and the top drive until 15 has been moved a certain distance downwards. The preparation of a further drill string stand 47 has just been completed at the preparation opening 21, and the stand prepared has been gripped by the gripping and transporting mechanism 22 which transports the drill string stand 47 to one of the storage areas 31 and 32.

Figure 7:
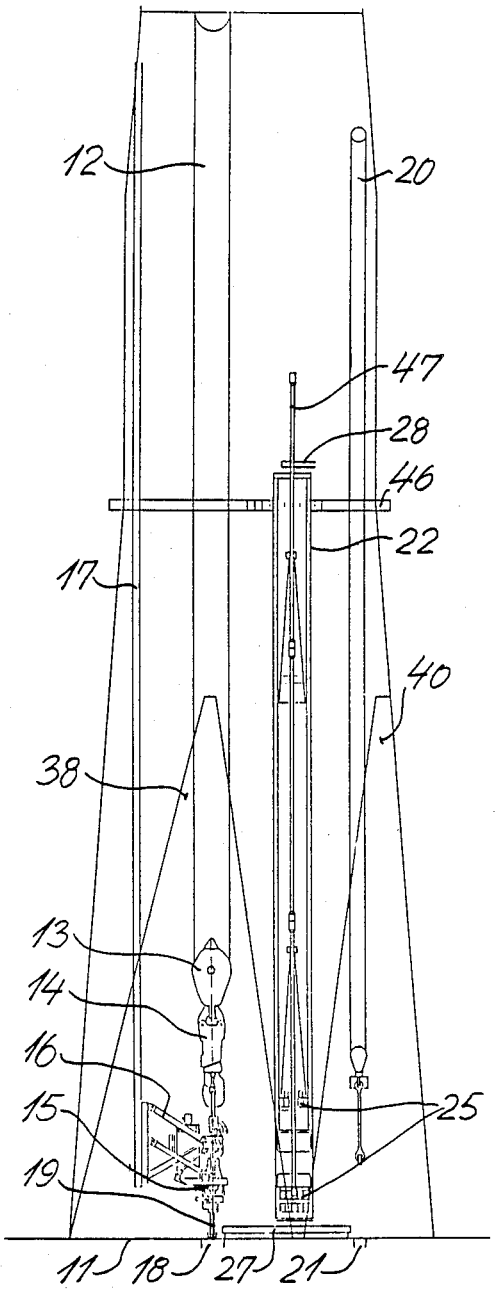
Figure 8:
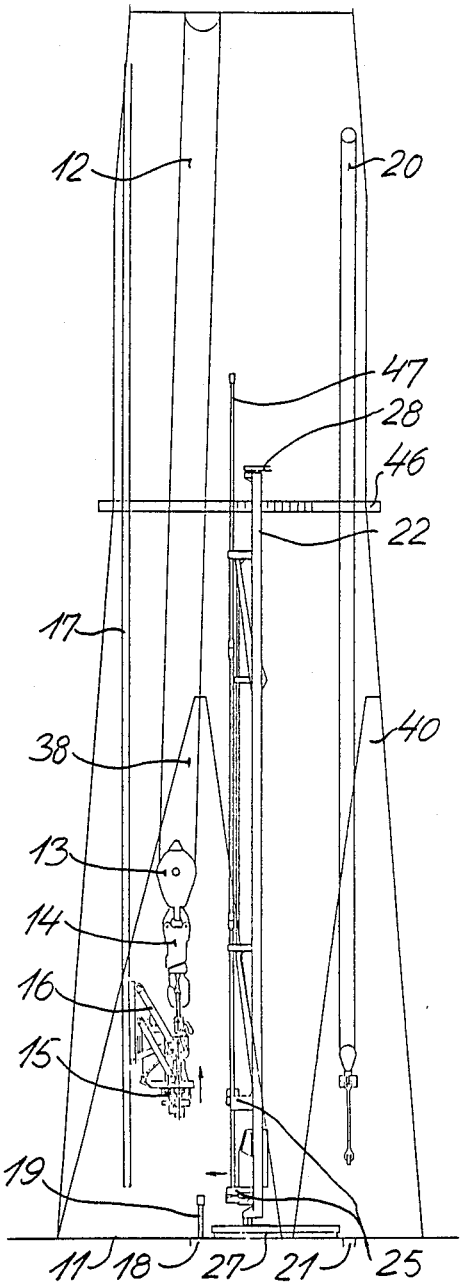

After a certain period of time the drill bit has penetrated such a distance into the underground that the top drive until 15 reaches its lower position as shown in FIG. 7, and the drilling operation has to be stopped for the addition of a further drill string stand 47. Therefore, the top drive unit 15 is disconnected form the upper end of the drill string, and the carriage 16 supporting the top drive until 15 is moved to a retracted position shown in FIG.8, whereby the top drive unit is moved to the left out of alignment with the drilling opening 18. While the top drive unit 15 is being moved upwards, a drill string stand 47 is gripped by the transporting mechanism 22 at one of the storage areas 31 and 32 and moved to a position in which the stand 47 is positioned immediately above and is aligned with the drill string 19, vide FIG. 8. Thereafter, the stand 47 may be connected to the drill string 19 by means of the spinning and torquing device 25. When the top drive unit 15 has reached its upper position the carriage 16 is returned to its normal, extended position,and the top drive unit may again be brought into driving engagement with the upper end of the newly mounted stand 47, whereafter the drilling operation may continue. After a certain drilling period the bottomhole assembly has to be replaced, which means that the drill string must be tripped out. The drill string is then disconnected into drill string stands 47, which are stored in the storage areas 31 and 32. The new bottomhole assembly may, however, have been prepared beforehand at the preparation opening 21 in the manner previously described and may be ready in one of the storage areas.

The possible occurrence of well heads and other structures in the area around the well centre does not always provide sufficient space to lower tubular lengths corresponding to about the length of two tubular singles (approximately 20 m) through the preparation opening 21, in this case, the first embodiment of the method according to the invention described above cannot be used.

Figure 9:
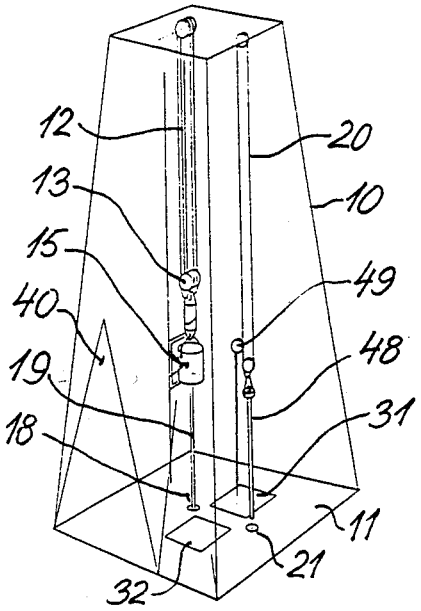
Figure 10:
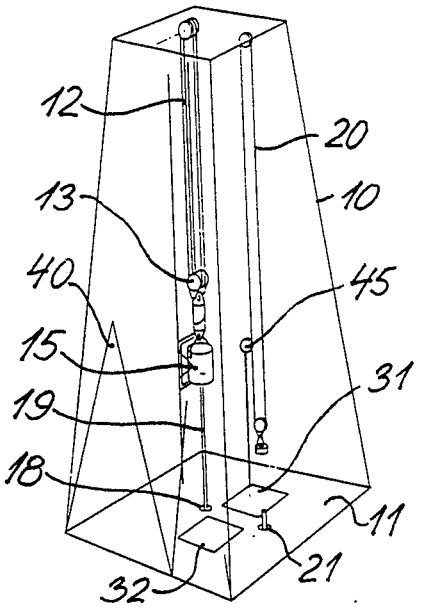
Figure 11:
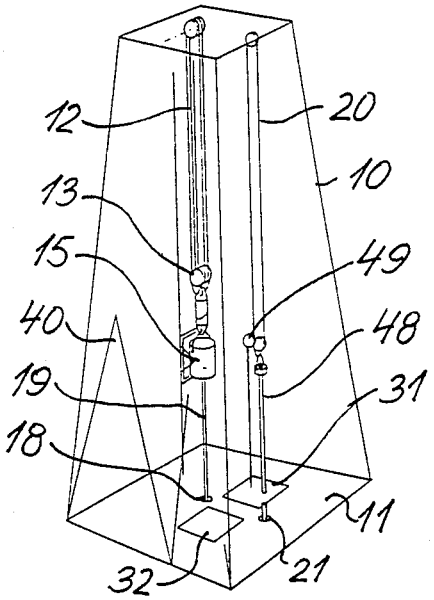
Figure 12:
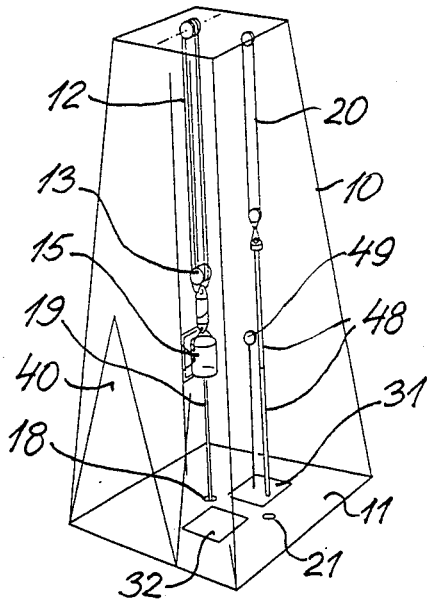
Figure 13:
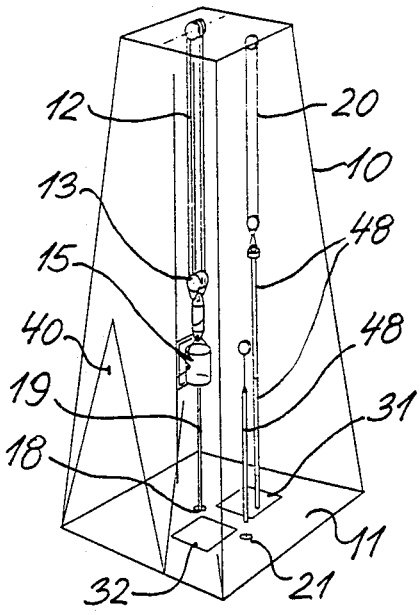
Figure 14:
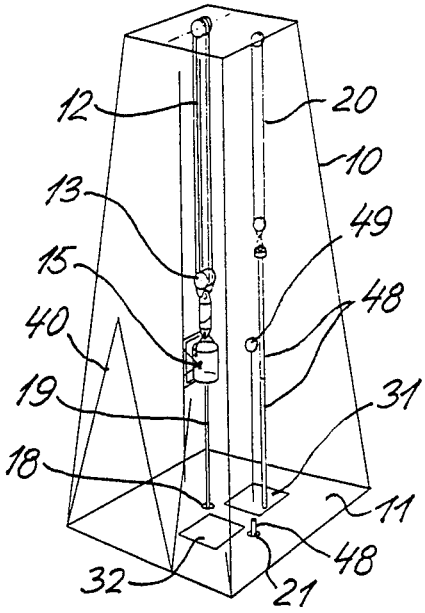
Figure 15:
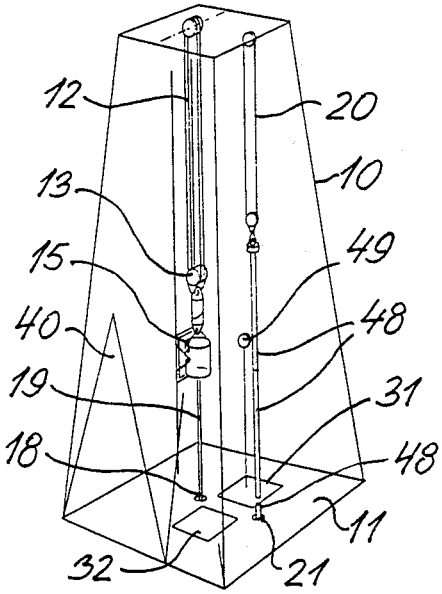
Figure 16:
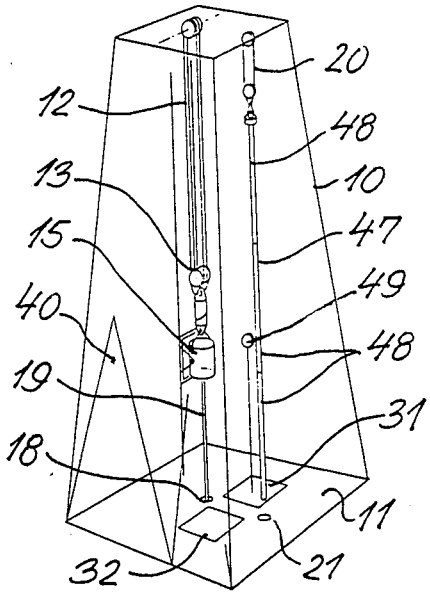

FIGS. 9–16 illustrate a slightly modified embodiment of the drilling rig according to the invention where the preparation opening 21 is defined by a main bushing which may be moved (displaced and/or tilted) so as to move the preparation between a first position (FIGS. 9–12, 15 and 16) and a second position (FIGS. 13 and 14). By means of such a drilling rig a triple stand 47 may be prepared form single tubulars 48 in the following manner:

A single tubular 48 is brought in from outside the derrick 10 through the V-door 40 and is lowered into the preparation opening 21, which is in its first position, by means of the preparation hoist 20, which is positioned vertically above the said first position of the preparation opening (FIG. 9). Slips are set, the hoist 20 is released (FIG. 10), and the next single tubular 48 is brought in. The hoist 20 suspends the single tubular above and adjacent to the one in the preparation opening (FIG. 11), while the two single tubulars are being assembled by the spinning and torquing device 25, not shown in FIGS. 9–16. Slips are released and the tubular assembly is lifted out of the preparation opening 21 by means of the hoist 20 (FIG. 12). The main bushing defining the preparation opening 21 is now displaced and/or tilted from its first to its second position so as to create a clear path above said opening. An auxiliary, smaller preparation hoist 49 is positioned vertically above the preparation opening 21 in its said second position. The next single tubular 48 brought in through the V-door 40 is suspended by the auxiliary preparation hoist 49 vertically above the preparation opening 21, which is in its said second position (FIG. 13). The single tubular is lowered into the preparation opening, slips are set, and the auxiliary preparation hoist 49 is released (FIG. 14). The main bushing defining the preparation opening 21 and carrying the single tubular 48 is now moved back to its said first position so as the align the tubular assembly suspended by the preparation hoist 20 with the single tubular 48 mounted in the preparation opening 21 (FIG. 15). The tubular assembly suspended by the preparation hoist 20 is now lowered and connected to the single tubular 48 in the preparation opening 21 by means of the spinning and torquing device. Slips are now released, and the completed triple stand 47 is lifted out of the preparation opening (FIG. 16), whereafter the triple stand is gripped by the gripping devices of the transporting mechanism 22, which may move the stand to one of the storage areas 31 or 32, where the stand is left.

Bottomhole subassemblies can be put together in a similar way as described above, but the number of parts in a 90′ (approximately 30 m) assembly may be different from three. By using the last method described above, the drill bit will be the last part to be added. The bit will then be hold at the preparation opening by a bit breaker rather than by the slips used for drill string sections and other tubular parts.

It should be understood that well casing stands and other components, such as logging assemblies, may also be prepared at the preparation opening 21 by procedures similar to those described above for bottomhole assembly parts and drill string stands. Thus, the method according to the invention renders it possible to reduce the idle time in operating a drill rig, whereby essential savings may be obtained.

I claim:

1. A method of handling tubular body sections at a drilling site by means of drilling equipment, which equipment comprises a drill floor or platform with a derrick extending upwards therefrom, a first hoist connected to the upper part of the derrick for passing a tubular body which includes a plurality of releasably interconnected tubular body sections through a drilling opening defined in the drill floor, storage means for storing a plurality of tubular lengths, each of which includes at least two releasably interconnected tubular body sections, being arranged on the drill floor, first transporting means for transporting tubular lengths between the storage means and said first hoist, a second hoist connected to the upper part of the derrick above a preparation opening defined by opening defining means and extending through the drill floor at a location spaced from the drilling opening and from the storage means, and second transporting means for transporting tubular lengths between the storage means and said second hoist, said method comprising:

transporting tubular lengths from the storage means to the drilling opening in a substantially vertical position by means of said first transporting means, releasably connecting said tubular lengths to the upper end of the tubular body and successively lowering the tubular body through the drilling opening by means of said first hoist, transporting tubular body sections to the preparation opening by third transporting means, forming a tubular length by releasably interconnecting said body sections while one of them extends through the preparation opening and another is suspended by means of said second hoist withdrawing the prepared length from the preparation opening by means of said second hoist, and transporting the prepared length to the storage means in a substantially vertical position by means of said second transporting means.

2. A method according to claim 1, wherein said tubular length includes three tubular body sections, said tubular length being formed by arranging a first tubular body section in the preparation opening so that a substantial part thereof extends below the drill floor or platform, and including the steps of: connecting a second tubular body section to the upper end of the first body section, and thereafter connecting a third tubular body section to the interconnected first and second body sections.

3. A method to claim 2, including the step of lowering the interconnected first and second body sections so as to place the first body section and a substantial part of the second body section below the drill floor or platform, whereafter the third body section is connected to the upper end of the second body section extending above said floor or platform.

4. A method according to claim 2, further comprising the steps of moving the interconnected first and second body sections upwards and out of the preparation opening by means of the second hoist, subsequently arranging the third tubular body section in the preparation opening by means of a third hoist arranged in the derrick so that a substantial part thereof extends below the drill floor or platform and subsequently connecting the interconnected first and second body sections to the upper end of said third body section extending above the said floor or platform.

5. A method according to claim 4, further comprising the step of laterally moving said opening defining means and said second and third hoist in relation to each other between first and second positions, the second and third hoists being substantially vertically aligned with the preparation opening in the first position and second position, respectively, the interconnected first and second tubular body sections being moved out of the preparation opening and being connected to the upper end of the third body section in the said first position of the second and third hoists, and the third body section being arranged in the preparation opening in the said second position of the second and third hoists.

6. A method according to claim 5, including the steps of moving said opening defining means in relation to the derrick from a first to a second position after removal of the interconnected first and second body sections from the preparation opening by means of said second hoist and prior to arranging said third body section therein by means of the third hoist, and from said second position back to said first position after arranging said third body section in the preparation opening and prior to connecting the interconnected first and second body sections to the upper end of the third body section.

7. A method according to claim 1, further including the steps of:

disconnecting tubular lengths from the upper end of the tubular body at the drilling opening, while successively withdrawing the tubular body upwards through the drilling opening, and transporting the disconnected tubular lengths from the drilling opening to the storage area means in a substantially vertical position by means of said first transporting means.

8. A method according to claim 1, further including the steps of:

transporting tubular lengths from the storage means to the second hoist in a substantially vertical position by means of said second transporting means, lowering each tubular length through the preparation opening by means of the second hoist, retaining the tubular length in the preparation opening, successively releasing the interconnection between adjacent tubular body sections above the upper surface of the drill floor, and transporting the released body sections from the preparation opening.

9. A method according to claim 1, wherein the tubular body is a drill string.

10. A method according to claim 9, wherein the tubular lengths comprise bottomhole assembly parts.

11. A method according to claim 1, wherein the tubular body is a well casing.

12. A method according to claim 1, wherein the tubular body is a production tubing.

13. A method according to claim 1, wherein the axial dimension of each of said tubular lengths corresponds substantially to the inner free height of the derrick.

14. A drilling rig comprising a drill floor or platform, a derrick extending upwards from the drill floor, a first hoist connected to the upper part of the derrick for passing a tubular body through a drilling opening defined in the drill floor, storage means for storing a plurality of tubular body lengths, each including at least two releasably interconnected tubular body sections, arranged on the drill floor, first transporting means for transporting tubular body lengths between the storage means and said first hoist, a second hoist connected to the upper part of the derrick above a preparation opening defined by opening defining means and extending through the drill floor at a location spaced from the drilling opening and from the storage means, second transporting means for transporting tubular body lengths from said hoist to the storage means, and means for interconnecting and disconnecting tubular body sections at the drilling and preparation openings, whereby tubular body sections may be assembled at the preparation opening into tubular body lengths, which are to be connected to the tubular body at the drilling opening.

15. A drilling rig according to claim 14, further comprising a third hoist and means for laterally moving the opening defining means and the second and third hoists in relation to each other between first positions in which the second hoist is substantially vertically aligned with the preparation opening, while the third hoist is located laterally spaced therefrom, and second positions in which the third hoist is positioned so in relation to the preparation opening that a tubular body section suspended by the third hoist may be moved into and out of the preparation opening while said second hoist is laterally spaced therefrom

16. A drilling rig according to claim 15, wherein said moving means comprise means for displacing said opening defining means defining the preparation opening in relation to the drill floor between a first position in which the preparation opening is located substantially vertically below the second hoist, and a second position in which the axis of the preparation opening is laterally offset from the vertical suspension line of said second hoist, said rig further comprising a third hoist positioned so that a tubular body section suspended thereby may be moved into and out of the preparation opening is said second position thereof.

17. A drilling rig according to claim 14, wherein said first and second transporting means comprise a single common gripping mechanism movable in either direction along a track extending between or passing the drilling opening, the storage area and the preparation opening.

18. A drilling rig according to claim 17, wherein said gripping mechanism comprises vertically aligned gripping devices arranged on a frame structure movable along said track.

19. A drilling rig according to claim 18, wherein means for connecting and disconnecting tubular body sections are arranged on said frame structure.

20. A drilling rig according to claim 18, wherein the frame structure is rotatable about a vertical axis located adjacent to said track.

21. A drilling rig according to claim 14, wherein the storage means are positioned between the drilling opening and the preparation opening.

22. A drilling rig according to claim 21, wherein the storage means are divided by the gripping mechanism track extending between the drilling and preparation openings.

23. A drilling rig according to claim 1, further comprising-third transporting means for transporting tubular section from a position outside the drill floor to said second hoist positioned above the preparation opening.

24. A drilling rig according to claim 14, wherein the derrick defines a first access opening and a second access opening which openings tubular body sections may be supplied directly to the drilling opening and the preparation opening respectively, from positions outside the drill floor.

25. A drilling rig comprising a drill floor or platform, a derrick extending upwards form the drill floor, a first hoist connected to the upper part of the derrick for passing a tubular body through a drilling opening defined in the drill floor, storage means for storing a plurality of tubular body lengths, each including at least two releasably interconnected tubular body sections, arranged on the drill floor, first transporting means for transporting tubular body lengths between the storage means and said first hoist, a second hoist connected to the upper part of the derrick above a preparation opening defined by opening defining means and extending through the drill floor at a location spaced from the drilling opening and from the storage means, second transporting means for transporting tubular body lengths from said hoist to the storage means, and means for interconnecting and disconnecting tubular body sections at the drilling and preparation openings, whereby tubular body sections may be assembled at the preparation opening into tubular body lengths, which are to be connected to the tubular body at the drilling opening, means for laterally displacing said opening defining means in relation to the drill floor between a first position in which the preparation opening is located substantially vertically below the second hoist, and a second position in which the axis of the preparation opening is laterally offset from the vertical suspension line of said second hoist, and a third hoist positioned so that a tubular body section suspended thereby may be moved into and out of the preparation opening in said second position thereof.

26. A drilling rig comprising:

a drill floor or platform, a derrick extending upwards from the drill floor, a first hoist connected to the upper part of the derrick for passing a tubular body through a drilling opening defined in the drill floor, storage means for storing a plurality of tubular body lengths, each including at least two releasably interconnected tubular body sections arranged on the drill floor, first transporting means for transporting tubular body lengths between the storage means and said first hoist, and a second hoist connected to the upper part of the derrick above a preparation opening defined by opening defining means and extending through the drill floor at a location spaced from the drilling opening and from the storage means, second transporting means for transporting tubular body lengths from said hoist to the storage means, and means for interconnecting and disconnecting tubular body sections at the drilling and preparation openings, whereby tubular body sections may be assembled at the preparation opening into tubular body lengths, which are to be connected to the tubular body at the drilling opening, and third transporting means for transporting tubular body sections to the preparation opening.

* * * * *

UNITED STATES PATENT AND TRADEMARK OFFICE

CERTIFICATE OF CORRECTION

PATENT NO. : 4,850,439

DATED : 25 July 1989

INVENTOR(S) : Thomas A. Lund

It is certified that error appears in the above-identified patent and that said Letters Patent is hereby corrected as shown below: On the title page:

In the Abstract, line 10, "strored" should be --stored--.

In the Abstract, line 29, "form" should be --from--.

In column 1, line 20, "side" should be --site--.

In column 4, line 67, "interconnection" should be --interconnections--.

In column 6, line 24, after "storage" insert --area--.

In column 7, line 2, "20 m" should be --30 m--.

In column 8, line 1, after "preparation" insert --opening--.

In column 8, line 41, after "assembly" insert --part--.

In column 9, line 19, after "Fig. 6" delete "for".

In column 9, line 20, "until" should be --unit--.

In column 9, line 29, "until" should be --unit--.

In column 9, line 49, the word "After" should begin a new paragraph.

In column 9, line 63, "21, in" should be --21. In--.

In column 10, line 2, after "preparation" insert --opening--.

In column 10, line 5, "form" should be --from--.

In column 10, line 52, "hold" should be --held--.

UNITED STATES PATENT AND TRADEMARK OFFICE

CERTIFICATE OF CORRECTION

PATENT NO. : 4,850,439

DATED : 25 July 1989

INVENTOR(S) : Thomas A. Lund

It is certified that error appears in the above-identified patent and that said Letters Patent is hereby corrected as shown below:

In column 12, line 3, "hoist" should be --hoists--.

In column 12, line 32, after "storage", delete "area".

In column 13, line 63, "claim 1" should be --claim 14--.

In column 13, lines 63 and 64, "comprising-third" should be --comprising third--.

In column 13, line 65, "section" should be --sections--.

In column 14, line 7, "a" (second occurrence) should begin a new paragraph.

In column 14, line 42, "a" (second occurrence) should begin a new paragraph.

In column 14, line 7, "form" should be --from--.

Signed and Sealed this

Thirty-first Day of July, 1990

*Attest:*

*Attesting Officer*

HARRY F. MANBECK, JR.

*Commissioner of Patents and Trademarks*